US005554085A

United States Patent [19]

Dalebout

[11] Patent Number: 5,554,085

[45] Date of Patent: Sep. 10, 1996

[54] WEIGHT-TRAINING MACHINE

[75] Inventor: William T. Dalebout, Logan, Utah

[73] Assignee: ICON Health & Fitness, Inc., Logan, Utah

[21] Appl. No.: 191,088

[22] Filed: Feb. 3, 1994

[51] Int. Cl.[6] ..... A63B 21/22

[52] U.S. Cl. ..... 482/137; 482/100; 482/112; 482/908

[58] Field of Search ..... 482/94, 95–103, 482/112, 129, 136–138, 908

[56] References Cited

U.S. PATENT DOCUMENTS

| | | | |
|---|---|---|---|
| D. 352,536 | 11/1991 | Byrd et al. | D21/195 |
| 2,648,540 | 8/1953 | Hunter . | |
| 3,640,528 | 2/1972 | Proctor . | |
| 3,647,209 | 3/1972 | La Lanne . | |
| 3,708,166 | 1/1973 | Annas . | |
| 3,971,555 | 7/1976 | Mahnke . | |
| 4,072,309 | 2/1978 | Wilson . | |
| 4,154,441 | 5/1979 | Gajda . | |
| 4,199,139 | 4/1980 | Mahnke et al. . | |
| 4,200,280 | 4/1980 | Goodwin . | |
| 4,275,882 | 6/1981 | Grosser et al. . | |
| 4,316,609 | 2/1982 | Silberman . | |
| 4,346,888 | 8/1982 | Szabo . | |
| 4,354,675 | 10/1982 | Barclay et al. . | |
| 4,382,596 | 5/1983 | Silberman . | |
| 4,390,179 | 6/1983 | Szkalak . | |
| 4,397,462 | 8/1983 | Wilmarth . | |
| 4,422,636 | 12/1983 | de Angeli . | |
| 4,426,077 | 1/1984 | Becker . | |
| 4,492,375 | 1/1985 | Connelly . | |
| 4,549,433 | 10/1985 | Salyer | 482/103 |
| 4,582,320 | 4/1986 | Shaw . | |
| 4,600,189 | 7/1986 | Olschansky et al. . | |
| 4,621,807 | 11/1986 | Stramer . | |
| 4,634,127 | 1/1987 | Rockwell . | |
| 4,643,420 | 2/1987 | Riley et al. . | |
| 4,721,303 | 1/1988 | Fitzpatrick . | |
| 4,744,559 | 5/1988 | Mahnke et al. . | |
| 4,763,897 | 8/1988 | Yakata . | |
| 4,826,157 | 5/1989 | Fitzpatrick . | |
| 4,834,396 | 5/1989 | Schnell . | |
| 4,854,578 | 8/1989 | Fulks . | |
| 4,898,381 | 2/1990 | Gordon . | |
| 4,900,018 | 2/1990 | Ish, III et al. . | |

(List continued on next page.)

OTHER PUBLICATIONS

Proform Fitness Products, Inc. Brochure for the Flex Plus Cross Training System, Copyright 1991–92.

Owner's Manual for Weslo, Inc, Flex Plus Cross Training Systems for model No. WL870500, 1991.

Proform Fitness Products, Inc. Brochure for the Edge 3001, Copyright 1992–93.

Ultimate Power Fitness Equipment Advertisement, 1992.

Vitamaster Systems ad slick for the 9732 Vita Flex II independent action stepper.

Roadmaster 1993 Fitness products lists, by Stock number, Description, Weight, Cube and Published Price.

*Primary Examiner*—Richard J. Apley
*Assistant Examiner*—John Mulcahy
*Attorney, Agent, or Firm*—Trask, Britt & Rossa

[57] ABSTRACT

A weight training machine has a base with an upright member secured thereto. A trolley is positioned on the upright member to move along its length. A plate is rotatably secured to the trolley to rotate relative thereto. An arm is rotatably secured and lockable in a variety of orientations relative to the plate. A cable is trained around pulleys positioned on the trolley and on the rotatable plate and connected at one end to the apparatus and at its other end to a resistance mechanism. The resistance mechanism through the cable resists rotation of the plate by the user when performing exercises. The apparatus may also include a second trolley positioned to move along the upright member with an arm extending therefrom. The cable may be further engaged around another pulley secured to the second trolley so that the resistance mechanism may resist movement of the second trolley by the user along the length of the upright member in the performance of exercises.

19 Claims, 9 Drawing Sheets

U.S. PATENT DOCUMENTS 4,911,436 3/1990 Lighter .
4,915,377 4/1990 Malnke et al. .
4,919,419 4/1990 Houston .
4,930,768 5/1990 Lapcevic .
4,964,632 10/1990 Rockwell .
4,982,955 1/1991 Heasley .
5,135,216 8/1992 Bingham et al. .
5,160,305 11/1992 Lin .
5,190,509 3/1993 Davison, Jr. .
5,195,937 3/1993 Engel et al. .
5,230,680 7/1993 Wu .
5,236,406 8/1993 Webber .
5,269,738 12/1993 Boren .
5,277,684 1/1994 Harris .
5,302,161 4/1994 Loubert et al. .
5,308,304 5/1994 Habing .
5,316,534 5/1994 Delebout et al. .
5,338,274 8/1994 Jones .
5,419,751 5/1995 Byrd et al. ..... 462/138

WEIGHT-TRAINING MACHINE

BACKGROUND OF THE INVENTION

1. Field of the Invention

This invention relates to exercise apparatus and particularly to apparatus suitable for performing weight-training-type exercises.

2. State of the Art

Exercise equipment has more recently been categorized into aerobic exercise machines and anaerobic exercise machines. Aerobic exercise machines include stepping exercise machines, treadmills and exercise cycles. Anaerobic exercise machines include a wide variety of weight-training or strenght-training exercise machines.

U.S. Pat. No. 2,648,540 (Hunter) illustrates a weight-training exercise machine suitable or useful for performing various exercises to develop skeletal muscles with a weight suspended and acted upon by gravitation. The weight acts as the principal resistance against movement of a particular skeletal muscle to develop strength in the muscle.

Other examples of weight-training machines include U.S. Pat. No. 4,316,609 (Silberman), U.S. Pat. No. 4,390,179 (Szkalak), U.S. Pat. No. 3,640,528 (Proctor), U.S. Pat. No. 4,382,596 (Silberman), U.S. Pat. No. 4,964,632 (Rockwell), and U.S. Pat. No. 4,492,375 (Connelly).

Weight-training machines, such as those described in the above-identified patents, typically may be configured to provide a variety of different exercises with the user positioned at different locations. In some cases, the weight-training machines are configured to employ a single resistance structure with cables or other mechanisms interconnected to the single resistance structure. For example, U.S. Pat. No. 4,346,888 (Szabo) illustrates a weight-lifting device having a central weight stack interconnected by a cable and pulley system to a carriage disposed about an upright member with wheels to be movable along the upright member. The device may be operated or reconfigured using the same carriage to provide for different exercises by the user. U.S. Pat. No. 4,492,375 (Connelly) also shows a machine with a carriage movable along an upright member to provide for different exercises at different locations along the vertical member. U.S. Pat. No. 5,135,216 (Bingham et al) also shows a weight-training machine with a carriage movable along the length of an upright member to provide for different exercises for different muscles of the user.

Some weight-training machines have employed an arm or lever which can be reconfigured to provide for different exercises. For example, U.S. Pat. No. 4,763,897 (Yakata) shows an exercise machine with a single weight and cable arrangement interconnecting to a lever which may be reoriented in relation to a platform to provide for a variety of different exercises selected by the user. U.S. Pat. No. 4,621,807 (Stramer) shows an exercise device with weights and counterweights interconnected to a central pulley to which a single arm is connected and reorientable to a variety of different configurations to provide for different exercises by the user. U.S. Pat. No. 4,898,381 (Gordon) also shows a weight-training machine with weight stacks interconnected by pulleys to a variety of levers that may be reconfigured for performing different exercises. U.S. Pat. No. 4,154,441 (Gajda) shows an exercise device involving pulleys and cable with a single weight annually disposed over a central column that slides on that central column.

Many of the weight-training machines of the hereinbefore-listed patents are either very complicated mechanically. In turn, they are difficult to assemble, difficult to operate, and difficult to maintain. Alternately they may be less complicated, but in turn unable to provide a wide variety or selection of exercises that can be repeatedly selected by the user to provide for a regular, repetitive program of weight-training exercises.

SUMMARY

An exercise machine has a frame that includes a base for positioning on a support surface and an upright member that extends from a lower end connected to the base to an upper end. The machine includes a trolley means which is movably associated with the upright member to move therealong. Locking means are provided for locking the trolley means to the upright member at different positions on the upright member.

The exercise machine also includes a plate rotatably mounted to the trolley means by connecting means. Arm means are secured to the plate to extend away therefrom. The arm means are operable by a user to rotate the plate relative to the trolley means to perform exercises.

The exercise machine also includes cable means which has a first end preferably secured to the frame although it may be secured to the trolley. First guide means are secured to the trolley for guiding the bight of the cable means from the first end of the cable means to the second guide means. The second guide means is secured to the plate and is positioned to receive the bight from the first guide means and guide the bight to third guide means. The third guide means is secured to the trolley means and positioned for guiding the bight from the second guide means to the second end of the cable means. Resistance means are connected at the second end of the cable means to resist movement of the second guide means relative to the first and third guide means upon the movement of the arm means by the user in performing exercises.

In a preferred construction, the arm means is rotatably secured to the connecting means to rotate thereabout relative to the plate and the trolley means. Preferably, the arm means includes indexing means for securing the arm means in a plurality of positions relative to the connecting means. Desirably, the connecting means is a shaft axle structure to permit rotation of the arm means relative to the plate and to permit rotation of the plate relative to the trolley means.

The indexing means may preferably include a plurality of spaced-apart apertures positioned on selected radials from the shaft. Pin means is preferably connected to the arm means to register with a selected aperture of the plurality of apertures. The arm means has a distal end preferably with user-engagement structure connected thereto. The user-engagement structure may be a cushion or padded structure for engagement by the user in performing exercises.

In a more desirable arrangement, the plurality of apertures are positioned in a circle about the shaft on the plate. Desirably, the pin means includes a biasing means connected to a shaft operable by the user. The biasing means continuously urges the shaft into the selected aperture.

The more desirable configuration of the trolley means includes a first support member connected to and spaced from a second support member a distance to movably receive the upright member therebetween. The trolley means desirably includes trolley guides to guide the trolley means along the upright member and to connect the first support member to the second support member.

In a preferred configuration, the locking means is a plurality of spaced-apart apertures formed in and along the upright member. A separate pin means connected to the trolley means is positioned to register with a selected aperture of the plurality of apertures formed along the upright member.

In a yet more preferred construction, a fourth guide means is connected to the frame to guide the bight of the cable means from the third guide means to the second end. The first, second, third and fourth guide means are each desirably a pulley configured to receive a cable thereabout. The resistance means may be either a weight stack or a hydraulic cylinder arrangement.

In an alternative configuration, a second trolley means is movably associated with the upright member. The second trolley means has a fifth guide means to guide the bight of the cable means from the first end of the cable means to the first guide means. A lever is connected to second trolley means for engagement by the user to perform exercises upon movement of the second trolley means relative to the upright member. The second trolley means is preferably positioned above the trolley means. The second trolley means also has trolley guides to guide the second trolley means in movement along the upright member.

In an alternate embodiment, the first and third guide means may be secured to the plate for movement therewith. The second guide means may be secured to the trolley. Thus, upon movement of the plate with the arm means by the user performing exercises, the first and third guide means on the plate move relative to the second guide means which is secured to the trolley means.

In yet an alternate configuration, an exercise machine of the invention includes a base for positioning on the support surface with an upright member secured at its lower end to the base. A first trolley means and a second trolley means are each movably associated with the upright member for movement therealong. Arm means for engagement by the user for movement in the performance of exercises is connected alternately and selectively to one of the first trolley means or the second trolley means. Locking means for locking the other of the first trolley means and the second trolley means to the upright member are also included. A cable means has a bight, which is trained around a first guide means on the first trolley means to guide the bight from the first end of the cable to a second guide means. The second guide means is connected to the second trolley means to guide the bight between the first guide means and the third guide means. The third guide means is connected to the frame to guide the bight between the second guide means and the second end of the cable. Resistance means are connected proximate the second end to resist movement of the cable means and, in turn, the arm means.

The first trolley means is desirably positioned above the second trolley means. The arm means is desirably connected to the first trolley means. Alternately, the arm means may be connected to the second trolley means.

In a desired construction, the locking means includes a plurality of space-apart apertures formed in the upright member with the locking means connected to the other of the first trolley means and the second trolley means. The locking means includes a pin to register with a selected aperture of the plurality of spaced-apart apertures.

The first guide means is preferably a pulley with the bight reeved thereabout. The second guide means is also a pulley with the bight reeved thereabout. The first end of the cable is preferably connected to the frame proximate the lower end of the upright member and the third guide means is preferably positioned proximate the upper end of the upright member. The first pulley means may also include a left pulley and a right pulley with the bight reeved first about the left pulley, then the second pulley, and then the right pulley and then said third guide means.

In an alternate arrangement, the third guide means may be secured to the frame proximate the lower end of the upright member with the first end of the cable means being secured to the upper end of the upright member.

In yet another configuration, the arm means is a rigid bar connected to one of the first trolley means and the second trolley means to extend away therefrom for engagement by the user. In an alternate arrangement, a second pin means may be connected to one of the first trolley means and the second trolley means also to be operable to register with a selected aperture of the plurality of spaced-apart apertures. In yet an alternate arrangement, the arm means may be removably connected to both the first trolley means and the second trolley means.

BRIEF DESCRIPTION OF THE DRAWINGS

In the drawings, which illustrate what is presently regarded as the preferred embodiment.

DETAILED DESCRIPTION OF THE INVENTION

Figure 1:
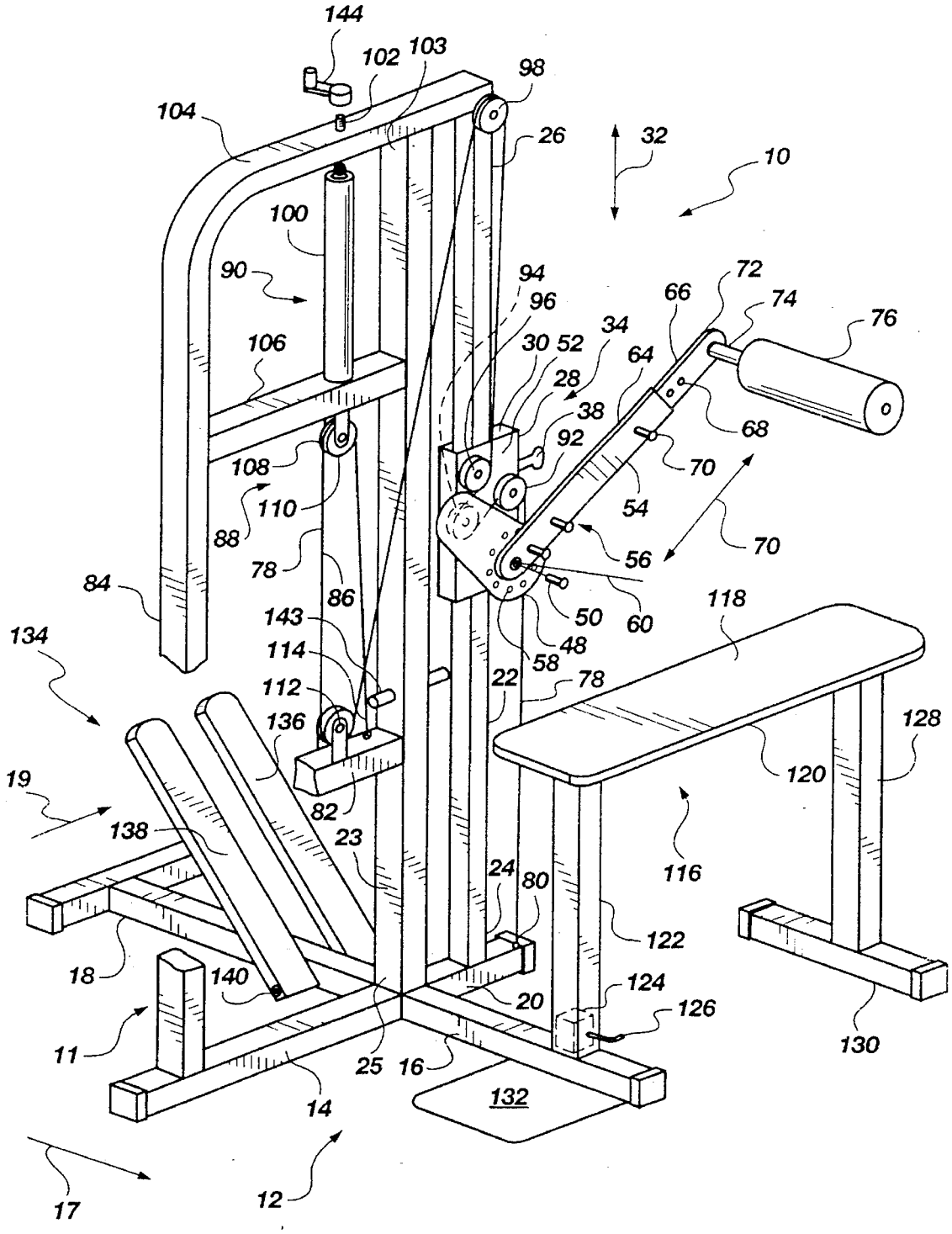
FIG. 1 is a partially-broken and partially-exploded perspective view of an exercise machine of the instant invention.

A perspective partially broken and partially exploded illustration of an exercise machine 10 capable of performing weight training exercises is depicted in FIG. 1. The exercise machine 10 has a frame 11 that includes a base 12 for positioning on a support surface. The base 12 includes a support member 14 and support member 16. The base 12 may be in a number of other configurations to provide sufficient support for the machine 10. The base 12 also includes extensions 18 and 20 to provide a footprint of sufficient length 17 and width 19 for stability as the user manipulates the exercise machine 10 in the performance of exercises.

The frame 11 also includes an upright member 22 which has a lower end 24 and an upper end 26. The upright member 22 is secured to the base 12 and extends upright therefrom. The lower end 24 may be secured to the base 12 at any convenient location consistent with operation of the exercise apparatus as hereinafter described. As here shown, the lower end 24 is secured to extension 20 and is spaced from a second upright 23 which is substantially parallel to the upright member 22 but spaced therefrom so the trolley 28 may freely move along the length of the upright member 22 between its lower end 24 and its upper end 26. The lower end 25 of second upright 23 is secured to the base 12.

It may also be noted that the upright member 22 extends substantially normal to the base 12 and more particularly to the members 14 and 20. Although the preferred arrangement illustrated in FIG. 1 has the upright member 22 extending normally from the base 12, the upright member may extend at an angle to the base 12 if desired.

Trolley means are movably associated with the upright member. As here shown, the trolley means is trolley 28. The trolley 28 is formed to have an interior 30 which is sized to receive the upright member 22 therein. The trolley 28 thus may move upwardly and downwardly 32 along the length of the upright member 22.

Figure 13:
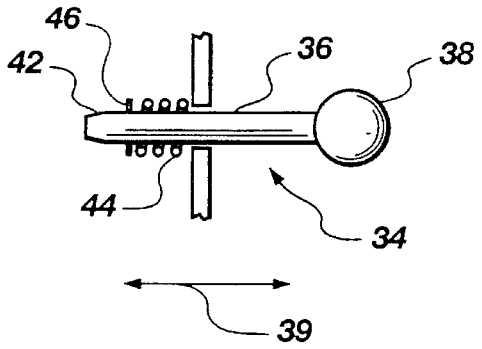
FIG. 13 illustrates a pin for use with an exercise machine of the instant invention.

The exercise machine 10 of FIG. 1 also includes locking means for locking the trolley 28 to the upright member 22. The locking means is preferably pin means which is illustrated as a pin 34. The pin 34 has a shaft 36 operable by the user by grasping the handle 38 best seen in FIG. 13. The shaft 36 can be moved inward and outward 39 to register with an aperture of the plurality of apertures 40 illustrated in FIG. 3 formed in and along the length of the upright member 22. The shaft 36 has a tapered end 42 to facilitate registration with the selected aperture of the plurality of apertures 40. A spring 44 is secured to the shaft 36 to urge the shaft 36 inwardly toward the selected aperture of the plurality of apertures 40 in the upright member 22. An indentation in the shaft 36 or a lip formed thereon or other means may be used to retain the spring 44 on the shaft 36.

Referring back to FIG. 1, a plate 48 is rotatably mounted to the trolley 28 by connecting means to rotate relative thereto. The plate 48 is rotatably here shown secured to the trolley 28 by shaft 50 which is attached to a first support member 52 of the trolley 28. Alternately the shaft 50 can be an axle to provide for ease of rotation. The shaft 50 may be bolted or welded to extend away from the support plate 52. Other arrangements that may be provided for rotatable connection such as pins, bolts or other related fastening configurations may be used as desired so long as the plate 48 rotates relative to the support member 52 of the trolley 28. The plate 48 is shown as a rounded elongate member. Other means may be used as a plate including a bar configured to rotate about shaft 50 at one end.

Arm means are provided for operation by the user in performing exercises. The arm means are secured to the plate 48 so the user may rotate the plate 48 relative to the trolley 28 in the performance of exercises. Although the arm means may be welded or bolted to the plate 48 in a fixed orientation, the preferred configuration of FIG. 1 shows an arm 54 rotatably secured about the shaft 50 to rotate relative to the plate 48. The arm 54 illustrated has a pin 56 comparable to the pin 34 which is positioned to register with a plurality of apertures 58 formed in the plate 48 on radials 60 extending away from the aperture 62 which receives the shaft 50.

The arm 54 as illustrated in FIG. 1 is shown having a first section 64 and a second section 66 which telescopes into the first section 64 with a plurality of apertures 68 into which a locking pin 70 may be inserted. The overall length 70 of the arm 54 may therefore be varied to accommodate users of different dimensions if desired.

Fixed to the outer end 72 of the arm 54 is a handle 74. The handle 74 is positioned and sized for engagement by the user. As here shown the handle 74 is configured to extend normally away from the arm 54 and has a cushion 76 positioned thereon to engage the body of the user performing exercises.

The exercise machine of FIG. 1 also includes cable means interconnected to resistance means and to the frame 11 to provide resistance to operation of the arm 54. The cable means here shown is a wire cable 78 which has a first end 80 secured to the frame 11 and more particularly to extension member 20. The cable 78 has a bight 86 which extends between the first end 80 and the second end 88 which is connected to resistance means 90. The cable means here shown is a wire cable 78. Chains, straps, ropes or the like may also be used if desired.

The frame 11 includes a first cross member 82 which extends transverse to the upright member 22 and interconnects with a third upright member 84 which is shown partially cut-away for convenience of illustration.

The cross member 82 provides increased strength and stability to the machine 10. Other arrangements may be used as desired to facilitate strengthening and stabilization of the frame 11. The cable 78 of FIG. 1 is trained around guides between the first end 80 and the second end 88. The bight 86 of the cable 78 is trained around a first guide means such as guide 92 for guiding the bight 86 from the first end 80 of the cable 78 to the second guide means such as guide 94. The first guide 92 is secured to the trolley 28 and more particularly to the support member 52.

The second guide 94 is secured to the plate 48 and is positioned to receive the bight 86 of the cable 78 from the first guide 92. The second guide 94 guides the bight 86 to a third guide 96 which in turn guides the bight 86 toward the second end 88 of the cable 78. If other means are used as the plate 48 such as a bar, the second guide 94 is secured to one end. A related lever may be secured thereto for operation by the user. Alternately, the arm may have a pin and rotate between two apertures formed in bar with the shaft 50 thereinbetween. Also, it can be seen that the third guide means 96 is optimal and that the bight 86 may extend directly to the second end 88 for connection to resistance means such as a hydraulic or gas shock, elastic bands or the like.

In the configuration of FIG. 1 a fourth guide 98 is secured to the frame 11 near the upper end 26 of the upright member 22 to receive the bight 86 from the third guide 96 and direct the guide toward the resistance means 90 to which the second end 88 of the cable 78 is connected.

As shown in FIG. 1, the resistance means 90 includes a hydraulic cylinder 100 which is secured to a shaft 102 that extends through a cross member 104 that is interconnected between the upper end 26 of the upright member 22, the upper end 103 of upright 23 and a third upright member 84. The hydraulic cylinder 100 extends downwardly through cross member 106 for interconnection via a bracket 108 to a guide 110. The bight 86 of the cable 78 is trained around lower guide 112 secured to the cross member 82. The bight 86 then extends over the block 110 and then to the cross member 82 where it is secured by a screw or other similar fastening structure.

Figure 5:
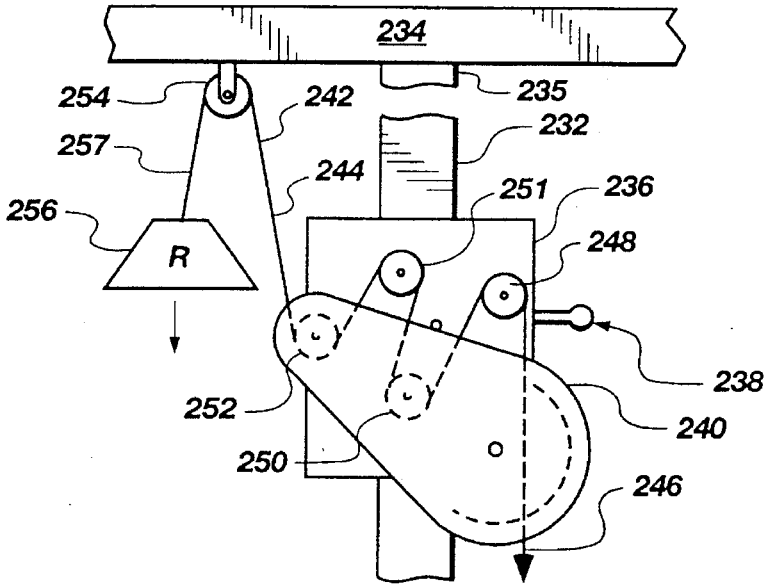
FIG. 5 is an alternate arrangement of the exercise machine of the invention.

Other resistance structures may be used including a simple weight, such as that illustrated in FIG. 5, or a weight stack to provide for adjustable and variable weights as presently known to those skilled in the art. Alternately, the second end 88 of the cable 78 may be secured to a lever arm with a gas shock such as presently illustrated and described in U.S. patent application Ser. No. 835,783 file on 14 Feb. 1992, the disclosure of which is incorporated herein by reference and which is now U.S. Pat. No. 5,316,534. Yet another useable resistance arrangement is disclosed in U.S. Pat. No. 4,921,242, the disclosure of which is incorporated herein by reference. Alternately, elastic bands may be used as resistance.

The exercise machine 10 of FIG. 1 also includes a bench 116 positioned relative to the arm 54 so the user may reside on the bench 116 and more particularly, the support surface 118 thereof, while performing exercises using the arm 54.

As seen in FIG. 1, the bench 116 has a underlying frame 120 to which the support surface 118 is affixed. The underlying frame 120 is connected to a front leg 122 which is removably secured to the support member 16 of the base 112. As shown, the leg 12 telescopes over a fitting 124 shown in phantom. The leg 122 may be secured to the fitting 124 by a pin 126. The bench 116 is also supported by a rear leg 128 and foot 130 for positioning on a support surface. The exercise machine 10 of FIG. 1 also includes a metal plate 132 connected to the base 112, and more particularly, to member 16 so the user may stand thereon while performing exercises manipulating the arm 54. The user is thus positioned to hold the exercise apparatus 10 stable with the user's weight when rotating the arm 54.

The exercise machine 10 of FIG. 1 also includes a stepping exercise apparatus 134. It is comprised of a left step 136 and a right step 138. The left step 136 and right step 138 are rotatably secured about a shaft 140 positioned through the extension 18. Connected to the left step 136 is a hydraulic resistance cylinder 141 to resist movement of the step 136 from the upper position (shown) to a lower position (not shown). The hydraulic cylinder 141 is connected to the step 136 by any conventional means as well as by a plurality of notches interconnecting to a hook structure of the hydraulic cylinder 141 as described and illustrated in U.S. patent application Ser. No. 013,746 filed on Feb. 4, 1993. The hydraulic cylinder 141 has associated therewith a biasing means (such as a spring) to continuously urge the pedal 136 to its upward position as shown in FIG. 1. A hydraulic cylinder 141 is connected at its upper end to a shaft 142 which is interconnected to the upright member 22. A second hydraulic cylinder similar to the hydraulic cylinder 141 is connected to the right shaft 143, but is not here shown for clarity. The right hydraulic cylinder not shown is further connected to the right step 138 in a manner comparable to that described with respect to left step 136.

As stated, the user in operation may be positioned on the support surface 118 of the bench 116. The user may then engage the cushion 76 associated with the handle 54 which is rotated to various positions about the shaft 50 relative to plate 48 and secured in a selected position by pin 56. The pin 56 registers with a selected aperture by the plurality of apertures 58 formed in the plate 48. The user then may urge the handle 54 to rotate about the shaft 50 in turn causing the second guide 94 to rotate away from the first guide 92 and the third guide 96. In so rotating, the bight 86 of the cable 78 moves about the guides 96 and 92, in turn, transmitting a tensional force through the cable 78 to the resistance means 90 and, more particularly, as shown in FIG. 1, to the hydraulic cylinder 100 via the guides 110 and 112.

The user may select other exercises by rotating the arm 54 about the shaft 50 to register with different apertures of the plurality of apertures 58 to in turn perform different exercises. Further, the user may move the trolley 28 upwardly and downwardly 32 along the length of the upright member 22 to position the plate 48 and more particularly the arm 54 relative to the user so that the user may perform different exercises including vertical knee raises, leg lifts, dips, squats, presses, overhead pulls, arm curls, leg curls and similar type exercises.

As seen in FIG. 1, the resistance means 90, and more particularly, the hydraulic cylinder 100, may be adjusted in the configuration illustrated. The shaft 102 that extends through the cross member 104 has a handle 144 connectable thereto to rotate the shaft 102 to in turn vary the resistance of the hydraulic cylinder 100 to movement of the cable 78 through the bight 86.

Figure 2:
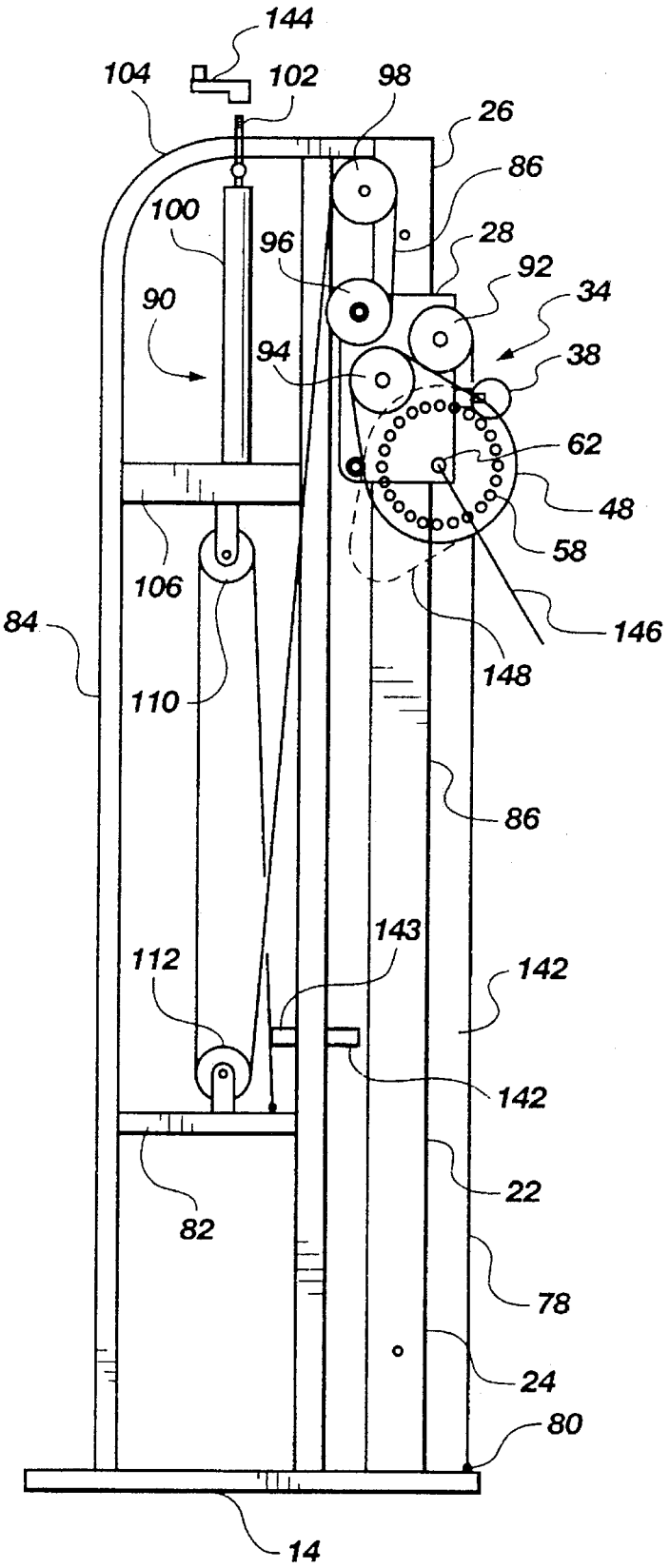
FIG. 2 is a partial side view of the exercise machine configured the same as the machine of FIG. 1.

Referring now to FIG. 2, a side view of a portion of a machine configured the same as machine 10 of FIG. 1 is illustrated. Referring specifically to the trolley 28, it can be seen that the plate 48 has a plurality of apertures 58 formed in a circle about the shaft 50 each on a radial, such as radial 60 as shown in FIG. 1 and radial 146 as shown in FIG. 2. Other configurations of apertures 58 may be selected by the user consistent with the positioning of the corresponding pin 56. A plurality of pins may be positioned on the handle 54 to interconnect and register with different apertures. In this fashion, the user may vary the position of the handle 54 relative to the plate 48 in order to select a wide variety of orientations in order to provide for a wide variety of exercises using the same resistance structure and operating mechanism. Indeed the user may simply operate the pin 56 in order to rotate the arm 54 to achieve a different or modified exercise for every aperture of the plurality of apertures 58. Further, the user may select another plurality of exercises by moving or repositioning in the trolley 28 up and down 32 along the length of the upright member 22 and locking it by operating pin 34 at a selected location to in turn vary the position of the handle 54.

As also seen in FIG. 2, the plate 48 is in a first position shown in solid and a second position shown in phantom. It may also be noted that in FIG. 2, the bight 86 extends from the first guide means 92 toward the second end 80 of the cable 78, which is attached to extension member 20. It also can be noted that the arm 54 as well as the bench 116 and the stepping exercise apparatus 134 are not shown in FIG. 2 along with other components for simplicity of illustration.

Figure 3:
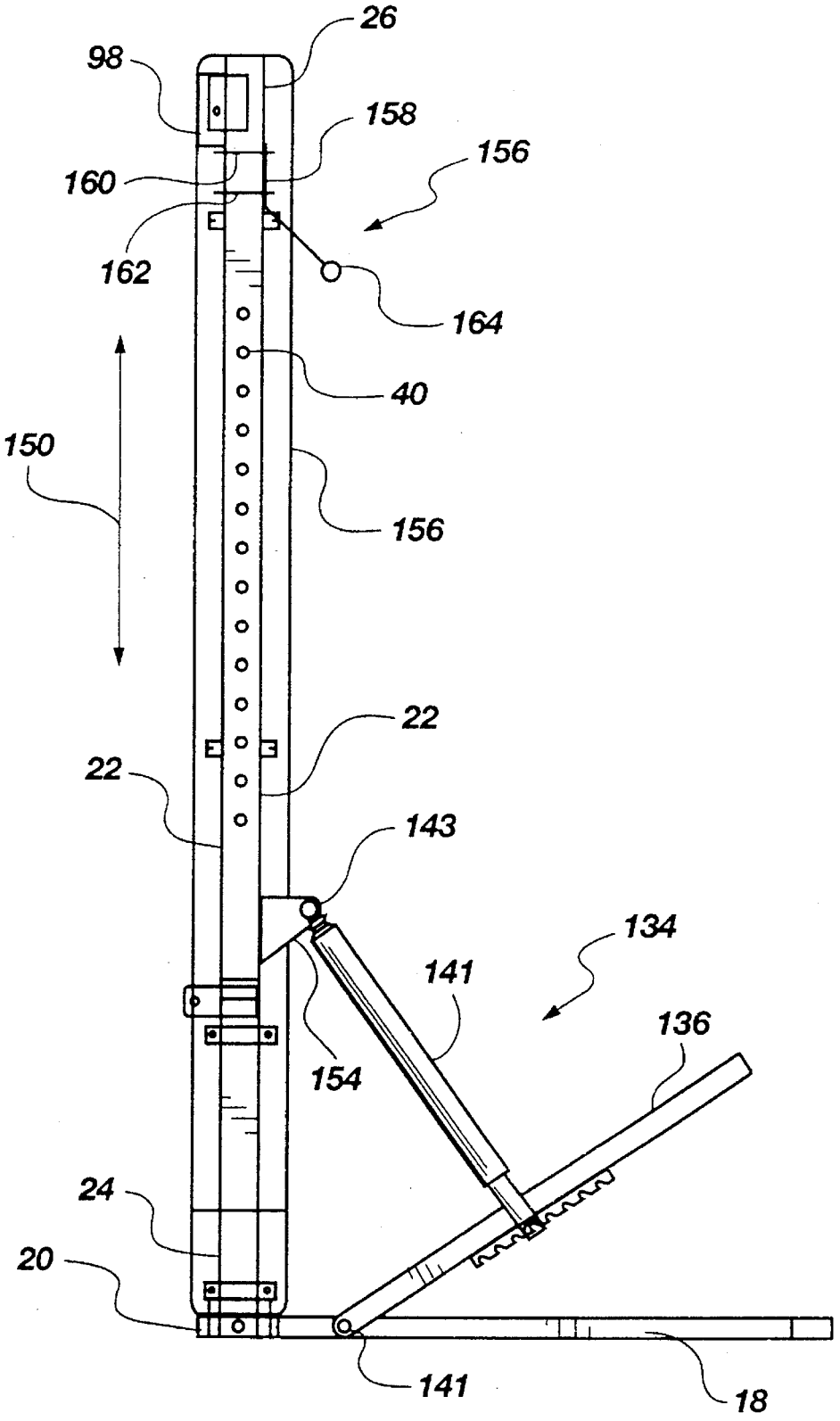
FIG. 3 is a partial view of the machine configured the same as the machine of FIG. 1.

As seen in FIG. 3, a plurality of apertures 40 is formed in and along the length 150 of the upright member 22. Each of the apertures is a recess formed in the upright member 22 and is sized to snugly receive the pin 34 as hereinbefore discussed. Also illustrated in FIG. 3 is the stepping exercise structure 134 in which the left step 136 is positioned to rotate about the shaft 141 positioned in the extension 18. The hydraulic cylinder 141 is interconnected between the left step 136 and the upright member 22. In FIG. 1, the cylinder 141 is connected by a connector 142 to shaft 143. In FIG. 3, the hydraulic cylinder 141 is connected to the shaft 143 which is spaced away from the upright member 23 by a bracket 154 secured to the upright member 23.

Also illustrated is the housing 156 which surrounds and encloses the resistance means 90 with its related guide means 110, 112 and related cabling structures to provide a more aesthetic appearance. Also shown in FIG. 3 is a handle structure 156 which is connected by a bracket 158 to the upright member 22 by bolts or rivets 160 and 162. The bracket 158 extends away from the upright member 22 a selected distance. A handle 164 is connected to the bracket 158. Thus a user positioned on the stepping exercise structure 134 will be able to grasp the handle 164 while performing stepping exercises.

Figure 4:
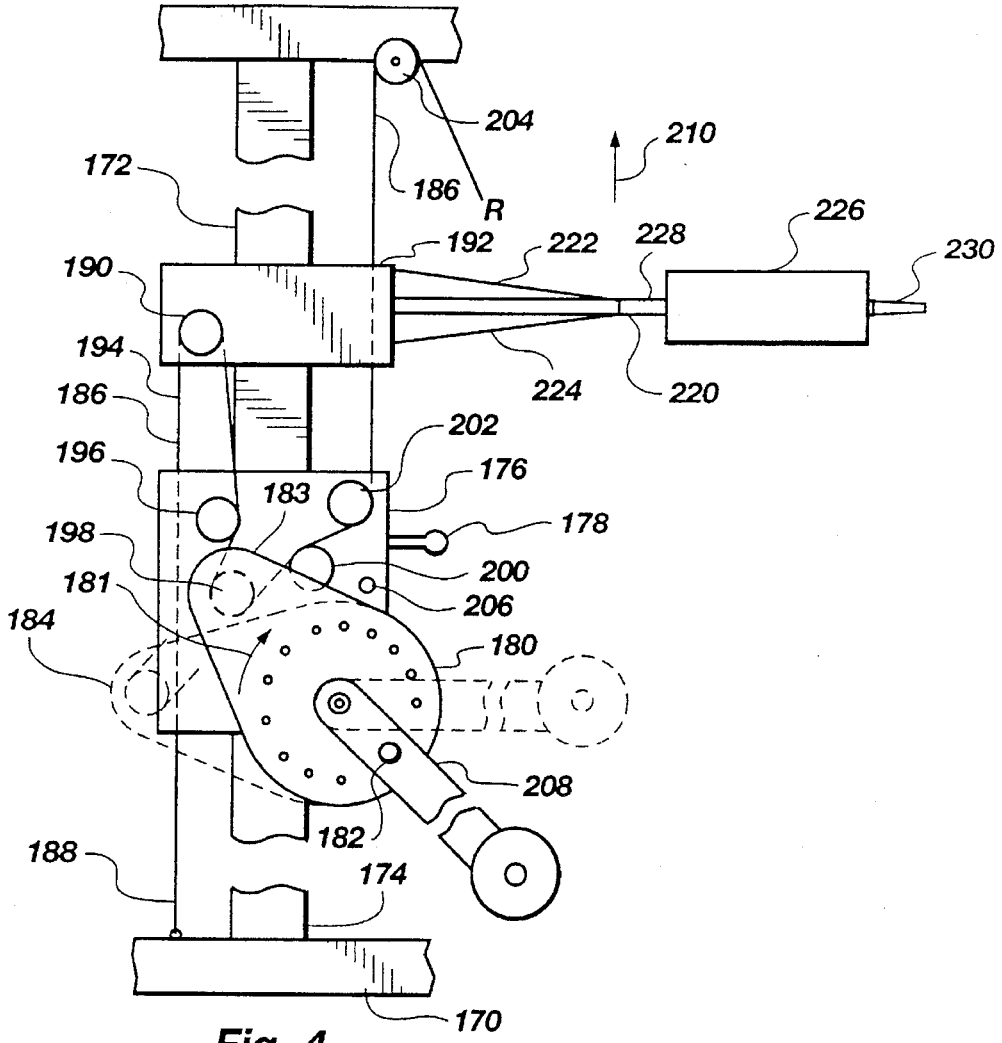
FIG. 4 is a simplified representation of an alternate arrangement of an exercise machine of the invention.

FIG. 4 is a simplified rendition of an exercise apparatus of the type of FIG. 1. In FIG. 4, a frame has a base 170 with an upright member 172 connected at its lower end 174. A first trolley 176 is associated with the upright member 172 to move therealong between a plurality of positions selected by operation of pin 178 to register with a plurality of apertures formed in the upright member 172 similar to that illustrated in FIG. 3 and described with respect to the structure of the machine in FIGS. 1 and 3.

The first trolley 176 of FIG. 4 has a plate 180 rotatably connected thereto to rotate around axle 182 between a first position shown in solid and a second position 184 shown in phantom. The apparatus of FIG. 4 has a cable 186 with a first end 188 connected to the frame to extend over a first guide 190 secured to a second trolley 192 which is also configured to be associated with the upright member 172 to move therealong. The cable 186 has a bight 194 which is trained over the first guide 190 to extend to a second guide 196 secured to the first trolley 176. The bight 194 extends to a third guide 198 which is connected to the plate 180 to rotate therewith and relative to the second guide 196 and a third guide 200. The third guide 200 guides the bight 194 of the cable 186 to a fifth guide 202. The fifth guide 202 in turn guides the cable 186 and the bight 194 to a sixth guide 204 which is secured to the frame. The sixth guide 204 guides the bight 194 from the fifth guide 202 to a resistance means which as hereinbefore discussed may include a hydraulic cylinder system such as, for example, the resistance means illustrated and described for the apparatus in FIG. 1.

It may be noted that the second trolley 192 in FIG. 4 is shown spaced from the first trolley 176 a distance which is only for clarity. In use, the first trolley 176 and the second trolley 192 would be in physical contact with each other in the at rest position because of the tension in the cable transmitted by the resistance means which tension urges the trolley 192 against the trolley 176.

As can be seen in FIG. 4 the plate 180 can rotate relative to the first trolley 176. The plate 180 is urged to rotate clockwise 181 by the tension in the cable 186 transmitted to the plate 180 by guide 198. A stop 206 is secured to the trolley 176. The outer edge 183 of the plate 180 contacts the stop 206 to hold the plate in a fixed first or at rest position. In operation, the user is then able to relocate the arm 208 about axle 182 between any one of a series of different positions as discussed with respect to the machine illustrated in FIGS. 1 and 2. With the arm 208 in a selected position, the plate 180 is rotated away from the step 206 against the tension in the cable 186.

In FIG. 4, the second trolley 192 may be moved upwardly 210 along the length of the upright member 172 by a user urging the arm 220 in an upward direction 210. Movement of the arm 220 in an upward direction 210 is resisted by the tension of the cable 186 transmitted to the second trolley 192 by first guide 190. More particularly, the bight 194 is trained around the first guide 190 so that movement of the trolley 192 and in turn the bar 220 is opposed by the resistance R.

The bar 220 as shown in FIG. 4 is connected to the trolley 192 and held firmly in place by additional bracket supports 222 and 224. A pad or cushion 226 may be positioned proximate the end of the bar 220 for engagement by the user in performing exercises. If the user is disposed to perform press-type exercises, portions 228 and 230 of the bar 220 are available for grasping by the hands of the user.

As can be seen from FIG. 4, the second trolley 192 is provided to add additional exercises to the machine employing the same cable 186 and the same resistance. Further, the number of exercises available from the second trolley can be varied by simply moving the first trolley 176 to different positions along the length of the upright member 172. Thus, low exercises (e.g., lifts, squats) and high exercises (e.g., press-ups) can be obtained as selected by the user.

FIG. 5 is a simplified illustration of an alternate configuration of an exercise machine. The machine has an upright member 232 which extends upward from a base (not shown) but similar to base 170 or base 12 shown in FIG. 1. A cross member 234 extends away from the upright member 232 near its upper end 235. A trolley 236 is movably associated with the upright member 232 to move therealong. The trolley 236 has a pin 238 which operates comparable to pin 34 discussed with respect to FIG. 1. The pin 238 registers with a plurality of apertures such as those illustrated in the upright member 22 of FIG. 3. A plate 240 is rotatably secured to trolley 236 to rotate relative to the trolley 236 by movement of an arm comparable to arm 54 illustrated in FIG. 1. An arm is not illustrated in FIG. 5 for clarity.

The machine has a cable 242 with a bight 244. The cable 242 is here connected to the base at its first end 246. The cable 242 extends around a first guide 248 which is connected to the trolley 236. The bight 244 extends around a second guide 250 secured to the plate 240 and to a third guide 251 which is also secured to the trolley 236. The bight 244 of the cable 242 extends from the third guide 251 to a fourth guide 252 attached to the plate 240. Then the bight extends to a fifth guide 254, which is secured to the cross member 234. The cable 242 and more specifically the bight 244, extend to a resistance 256 which may be a weight stack or a resistance system as hereinbefore discussed with respect to FIG. 1.

As can be seen in FIG. 5, plate 240 rotates by arm (not shown) relative to the trolley 236 and in turn causes the cable 242 and more particularly the bight 244 to tensionally transmit the resistance 256 to the plate 240 through guides 250 and 252 to resist rotation thereof. With the first end or the cable 246 secured to the base of the frame, the height of the resistance 256 at rest will not vary upon movement of the trolley 236. That is, the trolley 236 in FIG. 5 may be positioned along the length of the upright member 232 without varying length of the portion 257 of the cable 242 between the guide 254 and the resistance 256.

Figure 6:
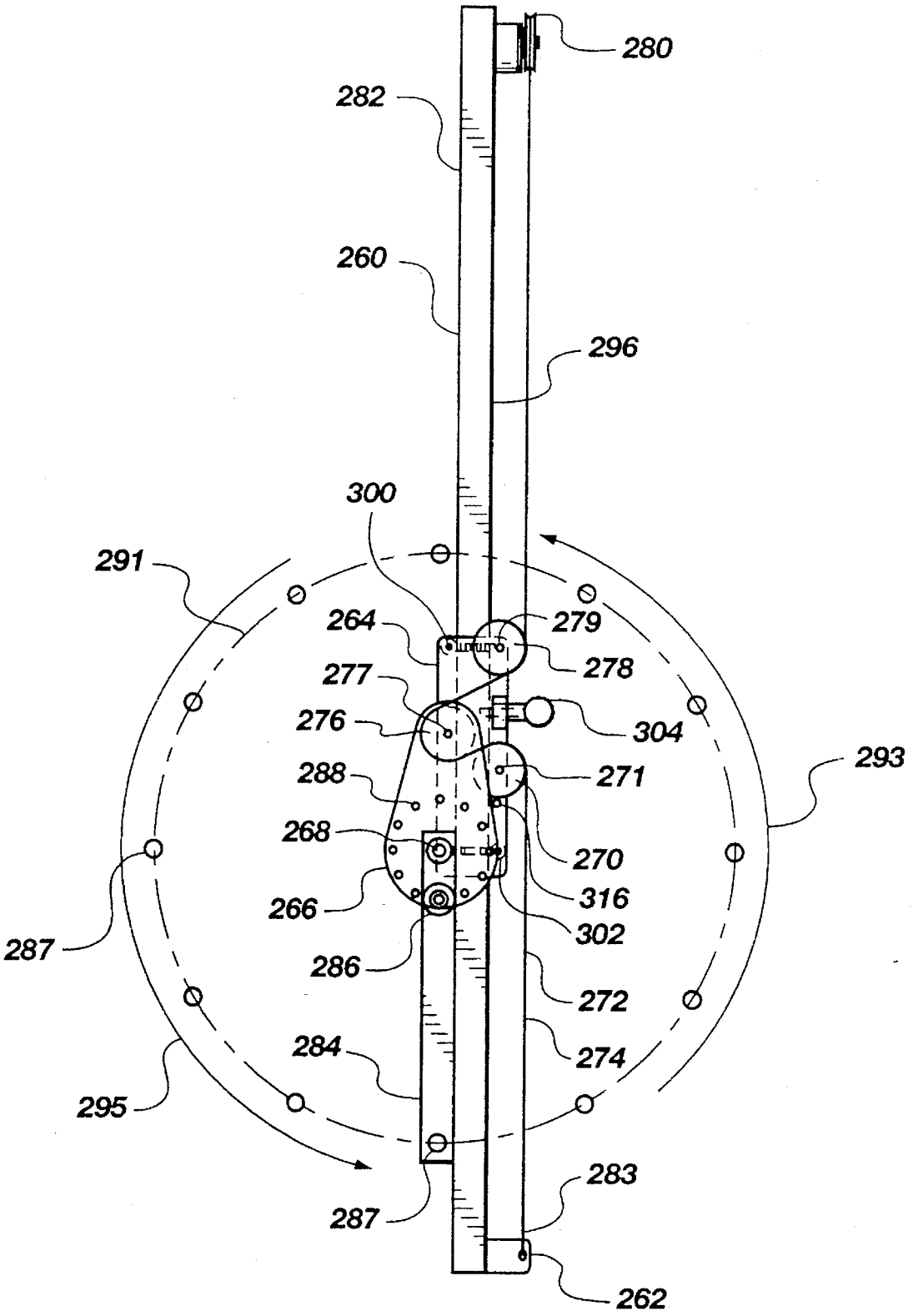
FIG. 6 is a partial side view of a portion of a machine similar to the machine of FIG. 1.
Figure 7:
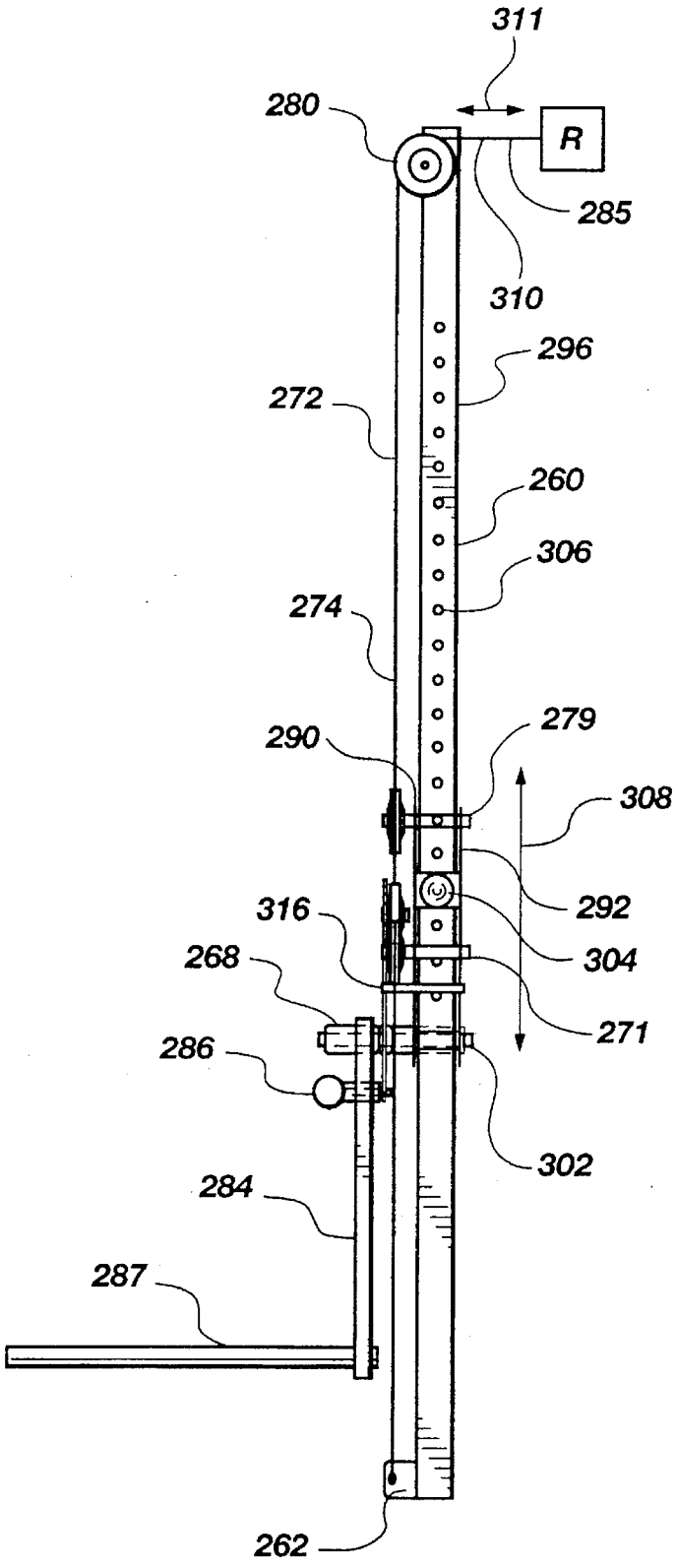
FIG. 7 is a side view of the structure of FIG. 6.

FIGS. 6 and 7 illustrate a portion of an alternate embodiment of an exercise apparatus for clarity. In FIGS. 6 and 7, an upright member 260 is connected to a base 262 to extend upwardly therefrom. A trolley 264 is positioned to move along the length of the upright member 260. A plate 266 is rotatably connected to the trolley 264 to rotate about an axle 268. The first guide 270 is positioned on the trolley 264 to receive the bight 272 of the cable 274. The bight 272 extends around the guide 270 on the trolley 264. A second guide 276 is secured to the plate 266 to receive the bight. The bight 272 continues around a third guide 278 secured to the trolley 264 and from the third guide 278 to a fourth guide 280 positioned approximate the upper end 282 of the upright member 260.

In FIGS. 6 and 7, the first end 283 of the cable 274 is connected to the frame and the second end 285 is connected to an appropriate resistance means as depicted in FIG. 7. As shown, the plate 266 is rotatable by operation of arm 284, which has a handle 287 for engagement by the user to perform exercises. The arm 284 can be reoriented relative the plate 266 with respect to any one of the plurality of apertures 288 formed in the plate 266. Thus, the handle 287 can be located in any one of the positions 289 shown in the circle 291 to perform exercises that involve upward movement 273 of the handle 287 and downward movement 295 of the handle 287.

It can also be seen in FIG. 4 that the trolley 264 has a front support 290 and a rear support 292. The axle 268 extends through the arm 284 and the plate 266 to the first support 290 and about the upright member 260 to the other support member 292. The axle 268 thus may act as a trolley guide to guide the trolley 264 about the upright member 260.

It may be noted that the first guide 270, the second guide 276, and the third guide 278 are all pulleys rotatably mounted about respective axles 271,277 and 279. Thus, the axle 271 of the first guide 270 acts as a trolley guide to contact the surface 296 of the upright member 260. Similarly the axle 279 for the third guide 278 acts as a trolley guide for trolley 264. To further stabilize the trolley 264 about the upright member 260, a trolley guide 300 is provided to abut the surface 296 of the upright member 260. A second trolley guide 302 is also provided for the same purpose. The trolley guides 300 and 302 and axles 271 and 279 are positioned to receive the upright member 260 therebetween so that the trolley 264 may move upwardly and downwardly 308 as discussed hereinbefore with respect to the structure of FIG. 1. Indeed it can be clearly seen that the trolley 266 may be moved upwardly and downwardly without moving the bight 272 of cable 274 relative to the fourth guide 280. In turn the resistance does not oppose such movement of the trolley 266 and the portion 310 of the cable between the fourth guide 280 and the resistance does not change in length 311. A pin 304 is provided to interact with a corresponding plurality of apertures 306 formed along the length 308 of the upright member 260 for securing the trolley 266 and in turn the arm 284 along the length of the upright member 260 for operation by the user in selected different positions.

Figure 14:
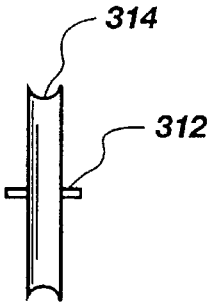
FIG. 14 illustrates a pulley for use with an exercise machine of the instant invention.
Figure 2:
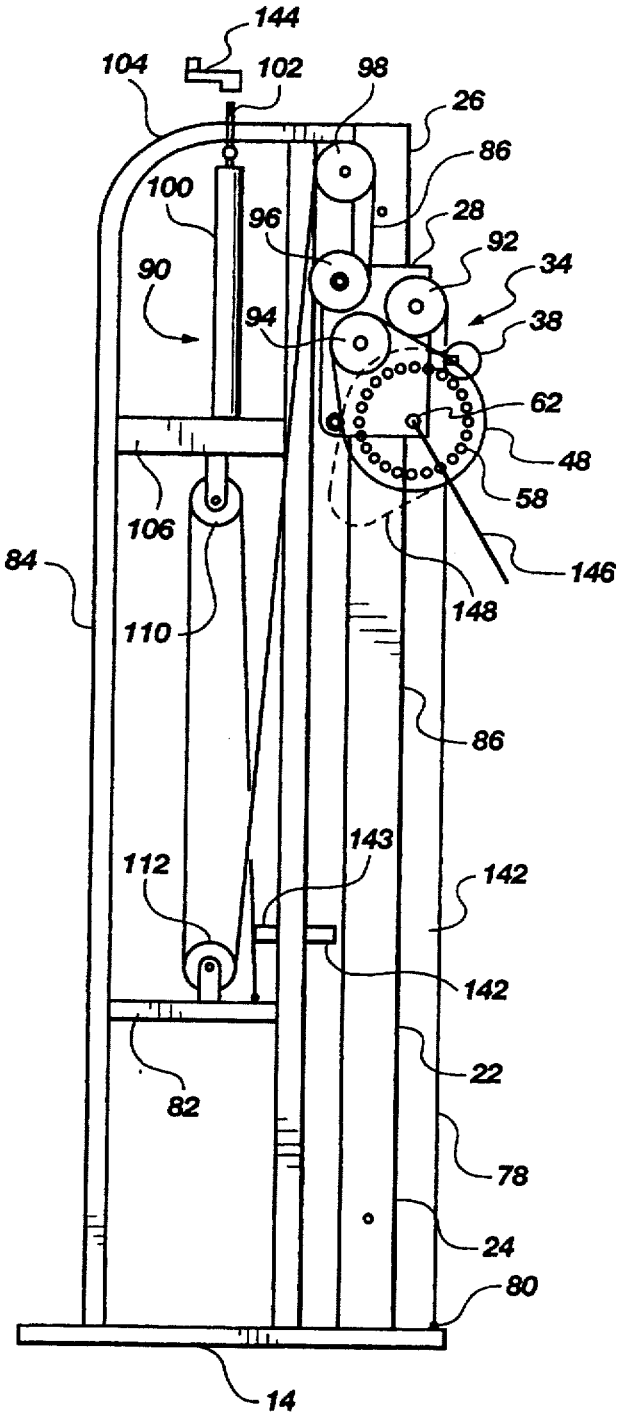
Figure 3:
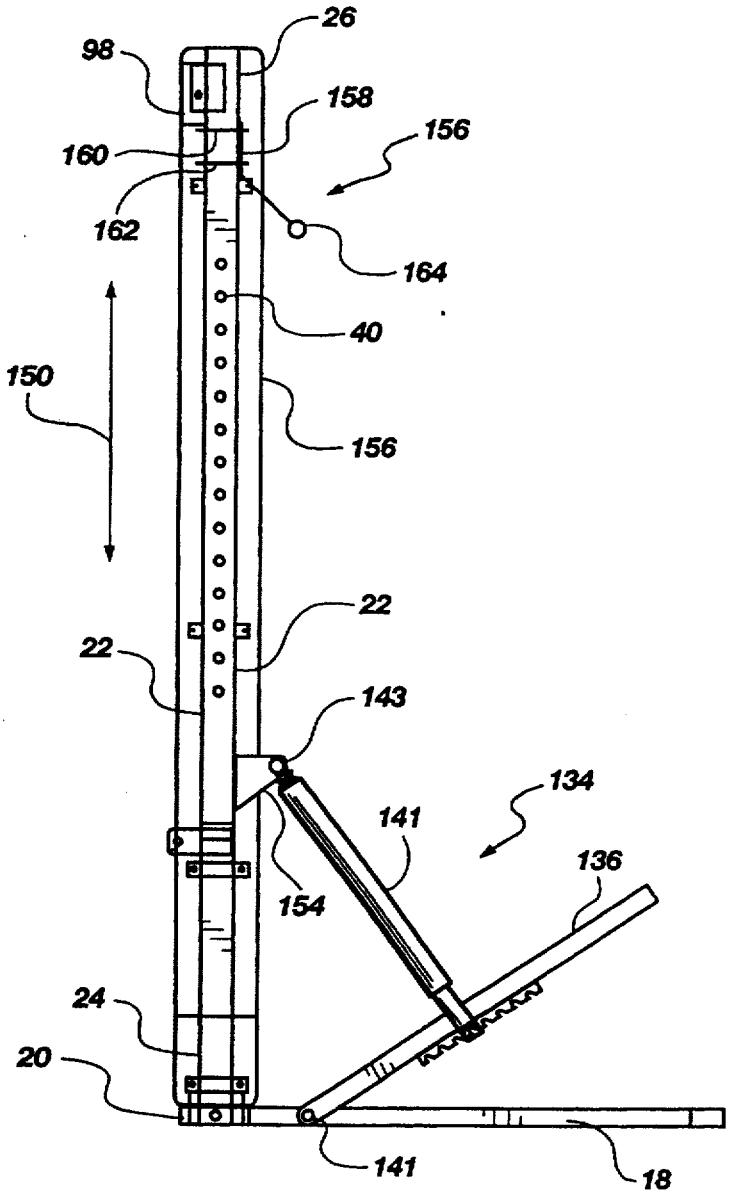
Figure 8:
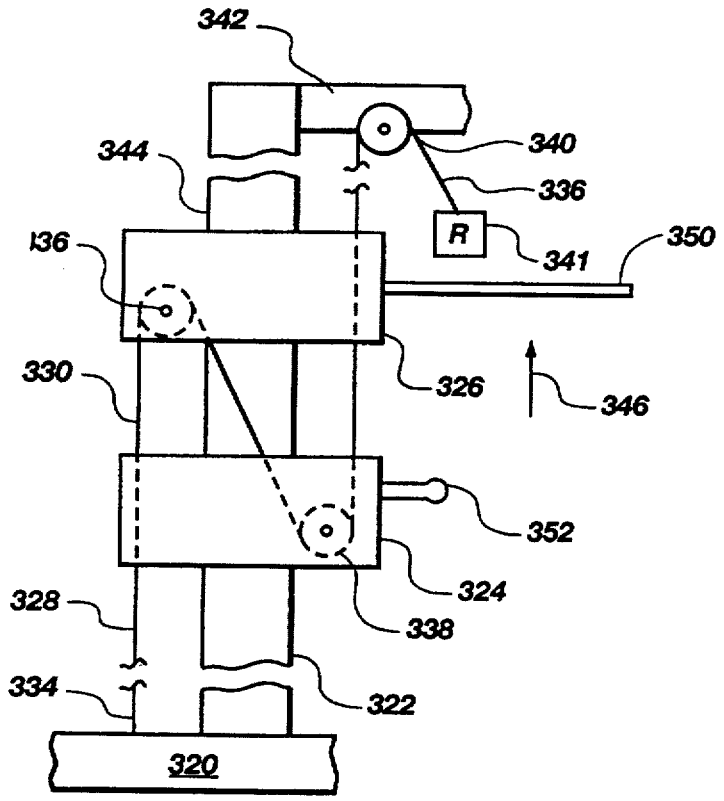
Figure 9:
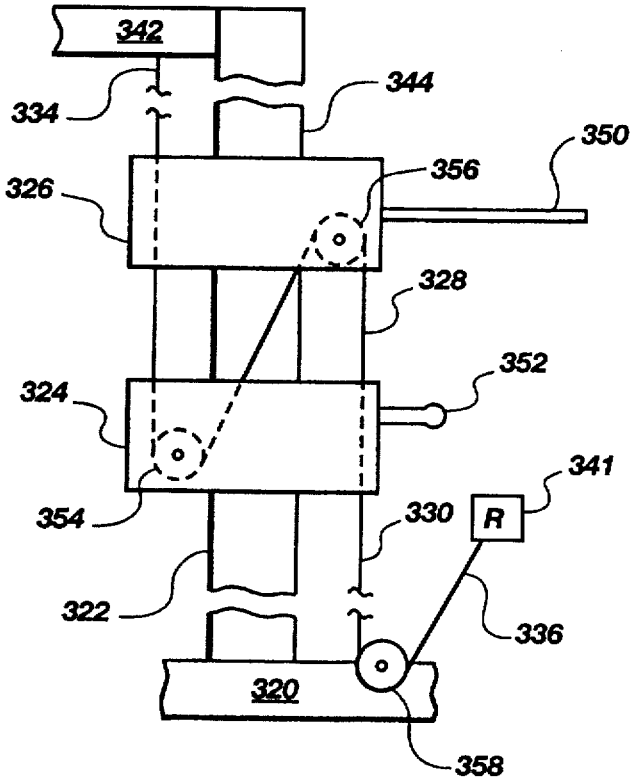
Figure 10:
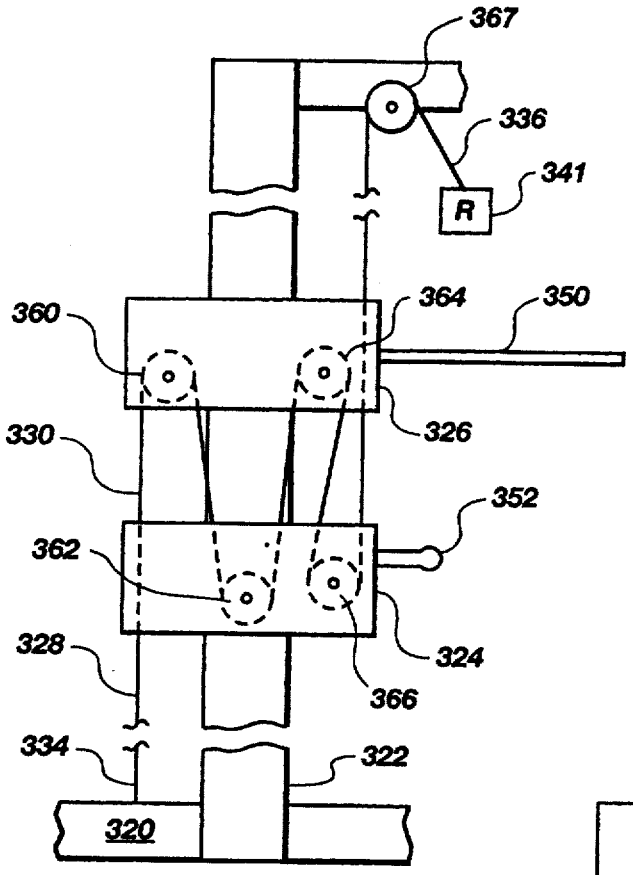
Figure 11:
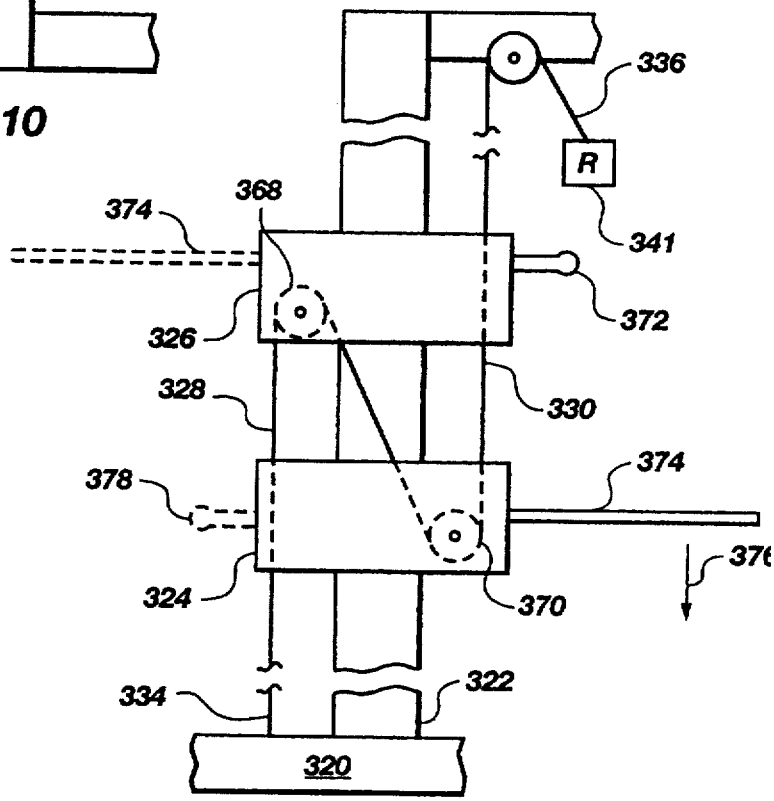
Figure 12:
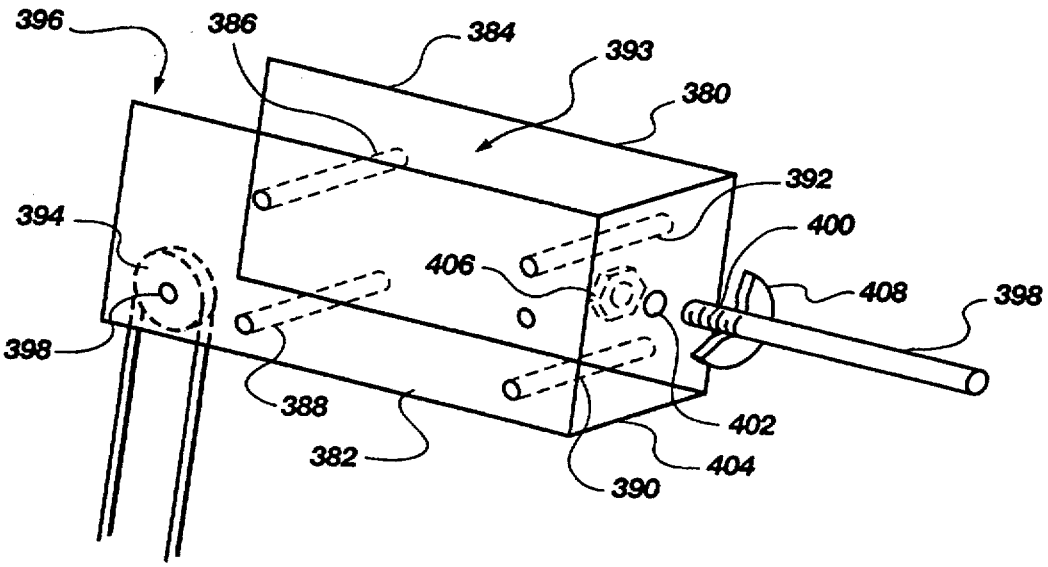
Figure 13:
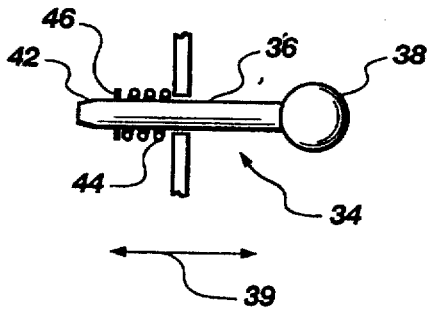
Figure 14:
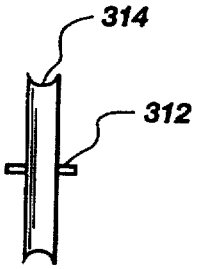

It may be noted that the pulleys 280, 270, 276, and 278, as better illustrated in FIG. 14, are conventional pulleys formed in a cylindrical fashion with an axle 312 formed therethrough, so that the pulley may be rotatably mounted as desired. Each pulley also has an arcuate surface 314 to receive and retain the cable 274 therein in a manner well known to those skilled in the art. The trolley 266 also has associated therewith in FIGS. 6 and 7 a stop 316 to retain the plate 266 in its first or at rest position.

FIGS. 8, 9, 10 and 11 shown alternate configurations of exercise machines. Each have a base 320 with an upright member 322 extending upwardly therefrom. Each have a first trolley 324 and a second trolley 326 positioned to move upwardly and downwardly along the upright member 322.

Each of the machines of FIGS. 8–11 have a cable 328 which has a bight 330. The cables have a first end 334 and a second end 336 connected to resistance means 338. Each first trolley 324 and each second trolley 326 is shown separated from the other along the length of the upright member 322 only for clarity. However, in a normal at rest position, each trolley 326 and each trolley 324 are positioned against each other before the commencement of exercises.

Figure 8:
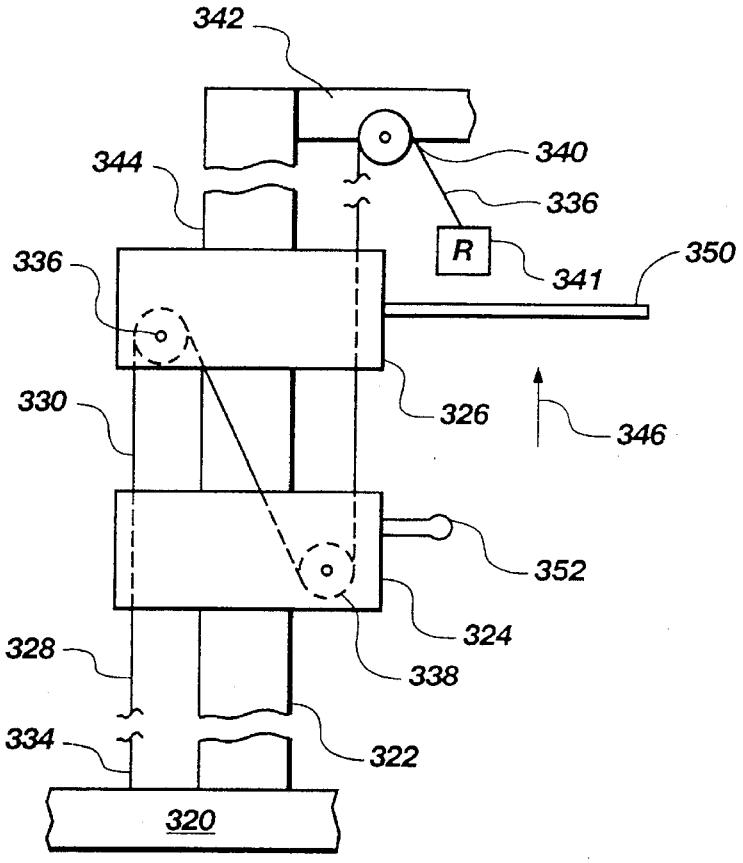
FIGS. 8–11 are simplified diagrams of alternate arrangements of the exercise machine of the instant invention.

Referring to FIG. 8, the bight 328 of cable 330 is trained about the first guide 336 to extend to a second guide 338 secured to the first trolley 324. The first guide 336 is secured to the second trolley 326. The second end 336 of the cable is connected to resistance means which may be a hydraulic shock absorber, a gas shock absorber or a resistance system having guides and weights. In FIG. 8, a resistance system is shown with the bight 328 trained around a third guide 340. The third guide is connected to a cross member 342 connected to the upper end 344 of the upright member 322. In use, the second trolley 326 may be urged in an upward direction 346 by the user engaging the bar 350 which is rigidly connected to the first trolley 326.

In moving the bar 350 of FIG. 8, the second trolley 326 moves upward thereby causing the resistance 341 to resist movement which resistance is transmitted as cable tension to guide 336. The bar 350 may be positioned at different locations along the length of the upright member 322 by operating pin 352 which interacts with a plurality of apertures formed in the upright member 322 in a manner similar to that illustrated with respect to the apparatus in FIG. 6 and 7.

Figure 9:
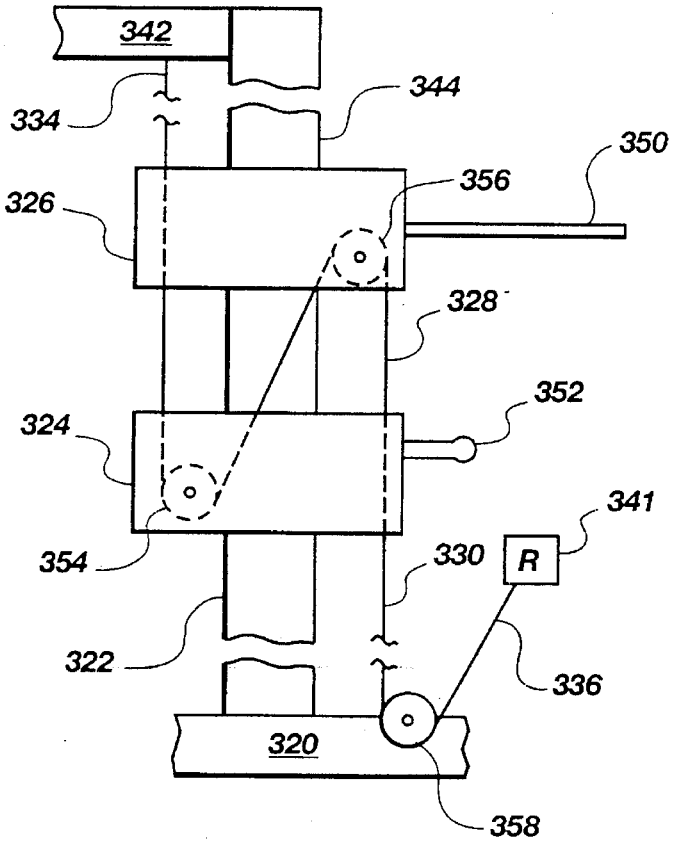

FIG. 9 depicts an alternate arrangement of the cable 330 and guides in which the first end 334 of the cable 328 is affixed to the upper cross member 342 secured proximate the upper end 344 of the upright member 322. The bight 330 of the cable 328 extends around the first guide 354 attached to the first trolley 324. A second guide 356 is attached to the second trolley 326 with a third guide 358 being rotatably secured to the base 320. Operation and use of apparatus in FIG. 9 is comparable to that described hereinbefore.

Figure 10:
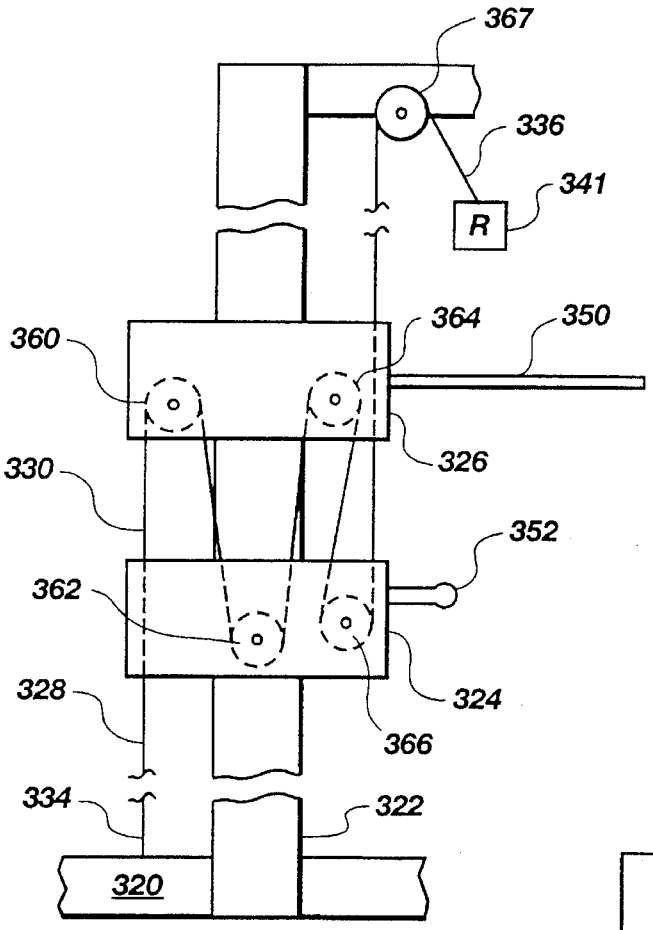

FIG. 10 shows an apparatus which has a first guide 360 attached to the second trolley 326 and a second guide attached to the first trolley 324. Also shown is third guide 364 attached to the second trolley 326 and a fourth guide 366 attached to the first trolley 324. The bight 330 of the cable 328 is trained around the first guide 360, then the second guide 362, the third guide, and then the fourth guide 366. The bight 330 continues over fifth guide 367 to the resistance 341. In operation here also, the user may select the location of the second trolley 326 by moving and positioning the first trolley 324 along the length of the upright member 327. The user may then perform exercises by moving the bar 350 against resistance 341 involving a system with mechanical advantage different from that of the systems of FIGS. 8, 9 and 11.

Figure 11:
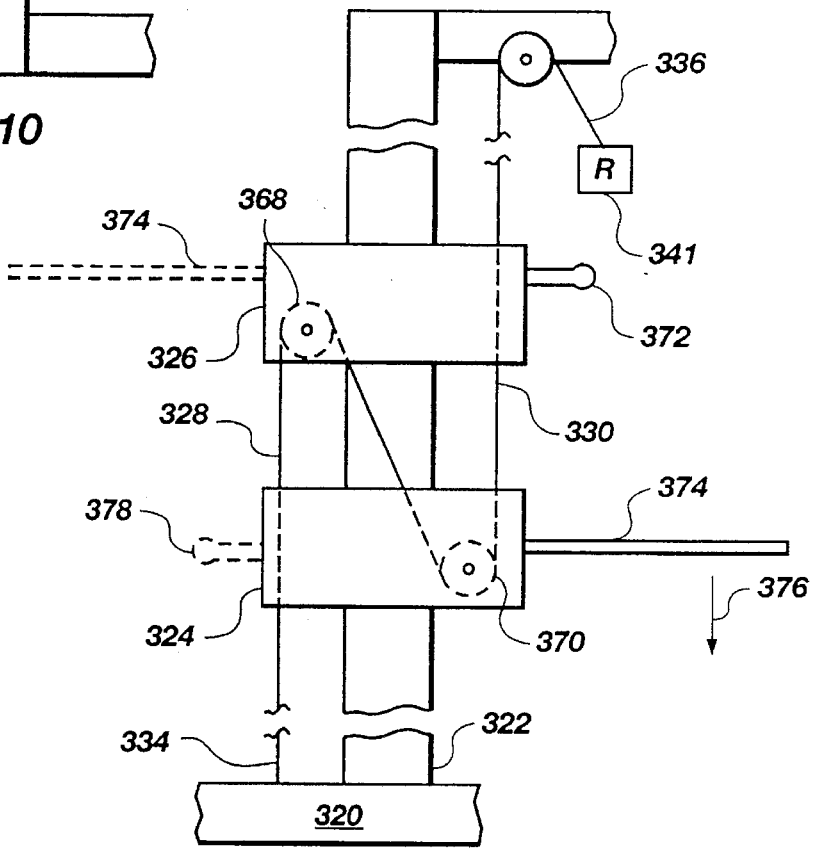

The configuration of the apparatus in FIG. 11 has a first guide 368 positioned in the second trolley 326. The second guide 370 is positioned in the first trolley 370. The second trolley 326 has a pin 372 comparable to pin 352 in FIGS. 8, 9 and 10, as well as, pin 304 in FIGS. 6 and 7 and pin 34 in FIG. 1. The pin 372 interacts with a plurality of apertures similar to apertures 306 shown in FIG. 7. The arm 374 is connected to the first trolley 324. In operation the arm 374 is urged in a downward direction 376 to perform exercises.

As shown in FIG. 11, the first trolley 324 may have a separate pin 378 which may be locked in a removed or out position as well as in a secured position. The bar or arm 374 may be removably positionable between the first and the second trolley as illustrated in phantom. Thus, the user may reconfigure the apparatus of FIG. 11 to have exercises in which the first trolley 324 is urged in a downward direction and in which the second trolley 326 is urged in an upward position. Alternately, each trolley 324 and 326 may have its own arm or bar such as bar 374.

Figure 12:
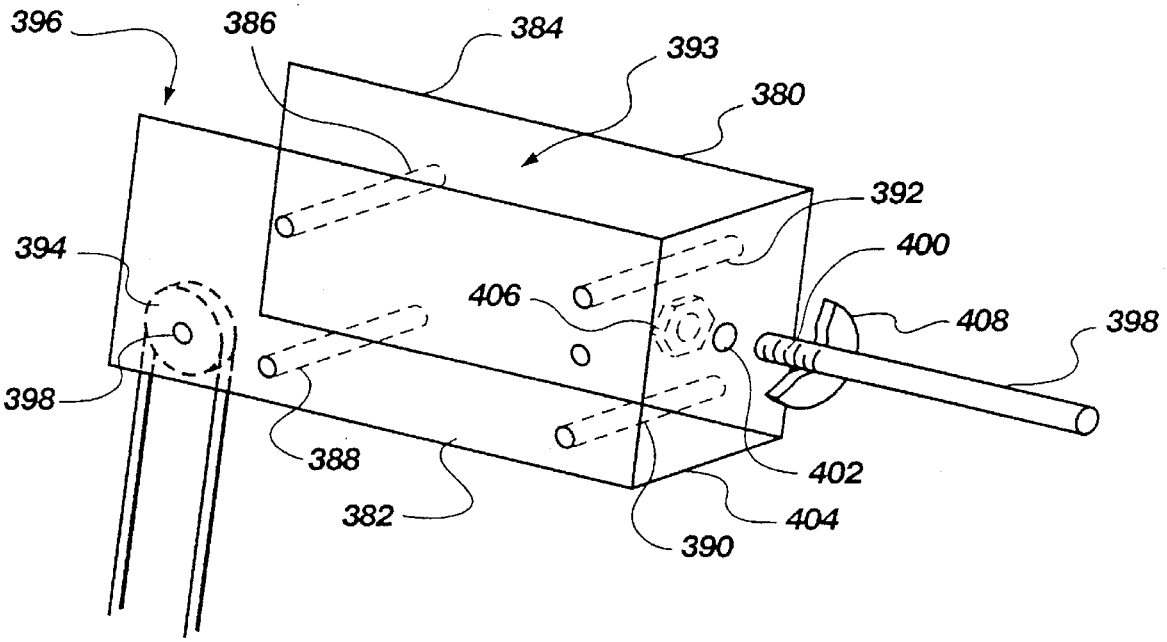
FIG. 12 is a perspective, partially-in-phantom and partially-exploded view of a trolley for use with an exercise machine of the instant invention.

FIG. 12 is a perspective view of a trolley 380 which may be used as a trolley in any one of the several embodiments illustrated and described herein. The trolley 380 has a front support 382 and a back support 384 with a plurality of trolley guides 386, 388, 390 and 392 positioned to space the front support 382 from the rear support 384 and to guide the trolley 380 along its associated upright member, which inserts into the space 393 defined by the guides. As stated hereinbefore, the guides 386, 388, 390 and 392 may also be axles for pulley or the axle for the related rotatable plate which is not here illustrated in FIG. 12. A pulley such as pulley 394 may be positioned on the interior 396 surface of the support 392 with its related axle 398 not functioning as a guide 388 as desired by the user. Also shown in FIG. 12 is a removable arm 398 with a threaded end 400 sized to snugly extend through an aperture 402 formed in the end plate 404 of the trolley 390. The threads 400 are secured by a bolt 406 positioned interior of the end plate 404. The bar 398 may have a cap or ring 408 formed thereon to provide lateral support and strengthen the arm 398 for use.

In operation it can be seen that the user has the option of selecting a large number of different exercises by simply reorienting the trolley or trolleys along the length of the upright member and at the selected location reorienting the arm with respect to the plate.

It is to be understood that the embodiments of the invention above described are merely illustrative of the application of the principles of the invention. The reference herein to the details of the illustrated embodiment is not intended to limit the scope of the claims which themselves recite those features regarded as essential to the invention.

What is claimed is:

1. An exercise machine comprising:

a frame for positioning on a support surface, said frame including an upright member having a lower end and an upper end;

trolley means adapted to said upright member for movement therealong between said lower end and said upper end;

locking means operably associated with said upright member and said trolley means for locking said trolley means to said upright member at selected locations along said upright:

a cable having a first end, a second end and a bight thereinbetween, said first end being connected to structure associated with said frame;

resistance means mechanically associated with said frame and operably linked with said second end of said cable to resist movement of said cable; and an exercise assembly for operation by a user to perform exercises, said exercise assembly including a plate rotatably mounted to said trolley means for movement relative to said trolley means, an arm rotatably attached proximate a first end to said trolley means to rotate relative to said trolley means, said arm extending outwardly from said trolley means proximate said plate to a second end, said second end being configured for contact with and movement by a user performing exercises, indexing means operably associated with said plate and said arm for detachably interconnecting said arm with said plate in a selected one of a plurality of positions, first guide means secured to said plate for operably contacting the bight of said cable and for displacing said bight upon movement of said arm, and second guide means secured to said trolley means for guiding said bight to and from said first guide means and for guiding said cable toward said resistance means and toward said first end of said cable.

2. The exercise machine of claim 1, further including an axle connected to said trolley, and wherein said arm is mechanically associated with said axle to be rotatable.

3. The exercise of claim 2, wherein said plate is mechanically associated with said axle to be rotatable.

4. The exercise machine of claim 3, wherein said plate has a first portion adjacent to a second portion, and wherein said first portion is associated with said axle to be rotatable, and wherein said first guide means is secured to said second portion.

5. The exercise machine of claim 4, wherein said indexing means includes a plurality of spaced apart apertures formed in said first portion of said plate member.

6. The exercise machine of claim 5, wherein each of said spaced apart apertures is positioned on a selected radial extending away from said axle; and wherein a pin mechanism is associated with said arm, said pin mechanism being moveable to register with a selected aperture of said plurality of spaced apart apertures.

7. The exercise machine of claim 5, wherein said plurality of spaced apart apertures are positioned in a circle about said axle, and wherein said pin mechanism comprises a pin with biasing means positioned to urge said pin into said selected spaced apart aperture.

8. The exercise machine of claim 7, further indcluding a frame guide connected to said frame, said frame guide being located and configured to receive said bight from said second guide means to guide said bight from said second guide means to said resistance means.

9. The exercise machine of claim 8, wherein said resistance means is a weight stack.

10. The exercise machine of claim 8, wherein said resistance means is a hydraulic cylinder.

11. The exercise machine of claim 1, wherein said second guide means includes a first guide connected to said trolley means for receiving said bight of said cable from said first guide means and guiding said bight toward said resistance means.

12. The exercise machine of claim 11, wherein said second guide means includes a second guide connected to said trolley means for receiving said bight of said cable from said first guide means and guiding said bight toward said first end of said cable.

13. The exercise machine of claim 12, wherein said first guide means, said first guide and said second guide are each pulleys.

14. The exercise machine of claim 1, wherein said second end of said bar includes a bar with a cushion thereon for contact by the user in performing exercises.

15. The exercise machine of claim 1, operably associated with said upright member and said trolley means for locking said trolley wherein said locking means has a plurality of spaced apart apertures formed in said upright member and pin structure connected to said trolley means to register with a selected aperture of said plurality of apertures.

16. The exercise machine of claim 15, wherein said trolley means further includes trolley guides to guide said trolley means along said upright member.

17. The exercise machine of claim 1, wherein said arm has a length and is framed to have a first portion and a second portion interconnectable to said first portion and moveable relative thereto to vary the said length of said arm.

18. The exercise machine of claim 1, further including user support means mechanically connected to said frame for supporting a user thereon performing exercises by moving said arm.

19. An exercise machine comprising:

a frame having a base for positioning on a support surface, and an upright member connected to and extending upwardly from said base;

a trolley movably associated with said upright member, for moving along said upright member;

locking means for locking said trolley means to said upright member at selected location along said upright member;

a plate pivotally mounted on said trolley to rotate relative to said trolley;

an arm rotatably mounted to said trolley and sized to extend away therefrom for movement by a user to perform exercises;

indexing means operably associated with said arm and said plate for detachably interconnecting said arm with said plate;

a cable having a first end, a second end and a bight therebetween, said first end being secured to structure associated with said frame;

resistance means operably linked with said second end of cable to resist movement of said cable and said plate member; and a first guide secured to said plate member for guiding the bight of said cable;

a second guide secured to said plate and positioned to guide said bight of said cable between said first guide and said resistance means; and a third guide secured to said plate and positioned to guide said bight of said cable between said first guide and said first end of said cable.

* * * * *

UNITED STATES PATENT AND TRADEMARK OFFICE

CERTIFICATE OF CORRECTION

PATENT NO. : 5,554,085
DATED : September 10, 1996
INVENTOR(S) : William T. Dalebout It is certified that error appears in the above-identified patent and that said Letters Patent is hereby corrected as shown below:

The sheets of drawings consisting of figures 2, 3,8,9,10, 11 and 12 should be deleted to appear as per attached sheets.

UNITED STATES PATENT AND TRADEMARK OFFICE

CERTIFICATE OF CORRECTION

PATENT NO. : 5,554,085
DATED : September 10, 1996
INVENTOR(S) : William T. Dalebout It is certified that error appears in the above-indentified patent and that said Letters Patent is hereby corrected as shown below:

In col. 2, line 2, after "are" delete "either";

In col. 2, line 59, at the beginning of the line, change "are" to --is--;

In col. 6, line 22, change "22" to --23--;

In col. 6, line 43, after "in" insert --the--;

In col. 6, line 52, after "the" at the beginning of the line, change "guide" to --bight--;

In col. 7, line 5, after "835,783" change "file" to --filed--;

In col. 7, line 16, after "has" change "a" to --an--;

In col. 7, line 19, change "12" to --122--;

In col. 7, line 25, change "112," to --12--;

In col. 8, line 41, change "second end" to --first end--;

In col. 8, line 54, change "cylinder 141" to --cylinder 141A--;

In col. 8, line 64, change "structure 156" to --structure 156A--;

In col. 9, lines 24-25, change "third guide 200" to --fourth guide 200-- (both occurrences);

In col. 9, line 51, change "step 206" to --stop 206--;

In col. 9, lines 60, change "bar 220" to --arm 220--;

In col. 9, lines 61, change "bar 220" to --arm 220--;

In col. 9, lines 64, change "bar 220" to --arm 220--;

UNITED STATES PATENT AND TRADEMARK OFFICE

CERTIFICATE OF CORRECTION

| | | |
|---|---|---|
| ATENT NO. | : | 5,554,085 |
| ED | : | September 10, 1996 |
| INVENTOR(S) | : | William T. Dalebout |

It is certified that error appears in the above-indentified patent and that said Letters Patent is hereby corrected as shown below:

In claim 15, line 1, after "claim 1" delete "operably associated with said upright member and said trolley means for locking said trolley";

In claim 19, line 7, change "trolley means" to --trolley--;

In claim 19, line 8, change "location" to --locations--; and

In claim 19, line 20, at the end of the line after "of" insert --said--.

UNITED STATES PATENT AND TRADEMARK OFFICE

CERTIFICATE OF CORRECTION

PATENT NO. : 5,554,085
DATED : September 10, 1996
INVENTOR(S) : William T. Dalebout It is certified that error appears in the above-indentified patent and that said Letters Patent is hereby corrected as shown below:

In col. 10, line 41, after "end" change "or" to --of--;

In col. 11, line 4, change "273" to --293--;

In col. 11, line 6, change "FIG. 4" to --FIG. 7--;

In col. 11, lines 26, 29, 34 and 43, change "trolley 266" to --trolley 264--;

In col. 11, line 46, after "11" change "shown" to --show--;

In col. 11, line 52, change "have" to --has--;

In col. 11, line 63, change "second end 336" to --second end 336A--;

In col. 12, line 5, change "326" to --324--;

In col. 12, line 22, before "apparatus" insert --the--;

In col. 12, line 25, after "guide" insert --362--;

In col. 12, line 30, after "third guide" insert --364--;

In col. 12, line 35, change "327" to --322--;

In col. 12, line 41, after "trolley" change "370" to --324--;

In col. 13, line 4, change "392" to --382--;

In col. 13, line 6, change "arm 398" to --arm 398A--;

In claim 8, line 1, change "indcluding" to --including--;

In claim 14, line 2, change "bar" to --arm-- (first occurrence);

Signed and Sealed this

Fourth Day of November, 1997

*Attest:*

Bruce Lehman

BRUCE LEHMAN

*Attesting Officer*

*Commissioner of Patents and Trademarks*